US005233957A

United States Patent [19]

Konrath et al.

[11] Patent Number: 5,233,957

[45] Date of Patent: Aug. 10, 1993

[54] FUEL INJECTION PUMP FOR INTERNAL COMBUSTION ENGINES

[75] Inventors: Karl Konrath, Freiberg/Neckar; Claus Koester, Ditzingen; Wolf-Ruediger Walk, Kornwestheim; Karl-Friedrich Ruesseler, Renningen; Helmut Tschoeke, Ostfildern; Mohammad-Ali Khosrawi, Ludwigsburg; Alfons Schoetz, Rutesheim, all of Fed. Rep. of Germany

[73] Assignee: Robert Bosch GmbH, Stuttgart, Fed. Rep. of Germany

[21] Appl. No.: 773,604

[22] PCT Filed: May 15, 1990

[86] PCT No.: PCT/DE90/00353

§ 371 Date: Nov. 22, 1991

§ 102(e) Date: Nov. 22, 1991

[87] PCT Pub. No.: WO90/15233

PCT Pub. Date: Dec. 13, 1990

[30] Foreign Application Priority Data

Jun. 10, 1989 [DE] Fed. Rep. of Germany ..... 3919064

[51] Int. Cl.[5] ..... F02M 39/00

[52] U.S. Cl. ..... 123/380; 123/179.17; 123/373

[58] Field of Search ..... 123/373, 380, 449, 503, 123/179.17

[56] References Cited

U.S. PATENT DOCUMENTS

| | | | |
|---|---|---|---|
| 2,965,089 | 12/1960 | Holley | 123/179.17 |
| 3,311,102 | 3/1967 | Voigt | 123/179.17 |
| 4,384,560 | 5/1983 | Jager | 123/380 |
| 4,432,321 | 2/1984 | Matsuda | 123/380 |
| 4,469,066 | 9/1984 | Yuzawa | 123/380 |
| 4,664,081 | 5/1987 | Eheim | 123/380 |
| 4,887,571 | 12/1989 | Eheim | 123/357 |

FOREIGN PATENT DOCUMENTS

| | | | |
|---|---|---|---|
| 0080113 | 6/1983 | European Pat. Off. | 123/380 |
| 3243349 | 5/1984 | Fed. Rep. of Germany | 123/380 |
| 3322214 | 1/1985 | Fed. Rep. of Germany | 123/380 |
| 1385894 | 1/1965 | France | 123/380 |
| 0133429 | 8/1983 | Japan | 123/380 |
| 2001132 | 1/1979 | United Kingdom | 123/380 |

*Primary Examiner*—Carl S. Miller
*Attorney, Agent, or Firm*—Michael J. Striker

[57] ABSTRACT

A fuel injection pump for internal combustion engines has a fuel-quantity adjusting member, and an adjusting device associated with the adjusting member and operative for altering a possible travel of the fuel-quantity adjusting member as a function of an atmospheric pressure. The device has a pivotally mounted two-armed stop lever against which the fuel-quantity adjusting member can be brought to rest. A circuit is provided with a working element which acts on the stop lever and changes its position or length following a closure and opening of the circuit. The adjusting device has a switching element which is acted upon by the atmospheric pressure and, as a function of atmospheric pressure closes and opens the circuit.

5 Claims, 1 Drawing Sheet

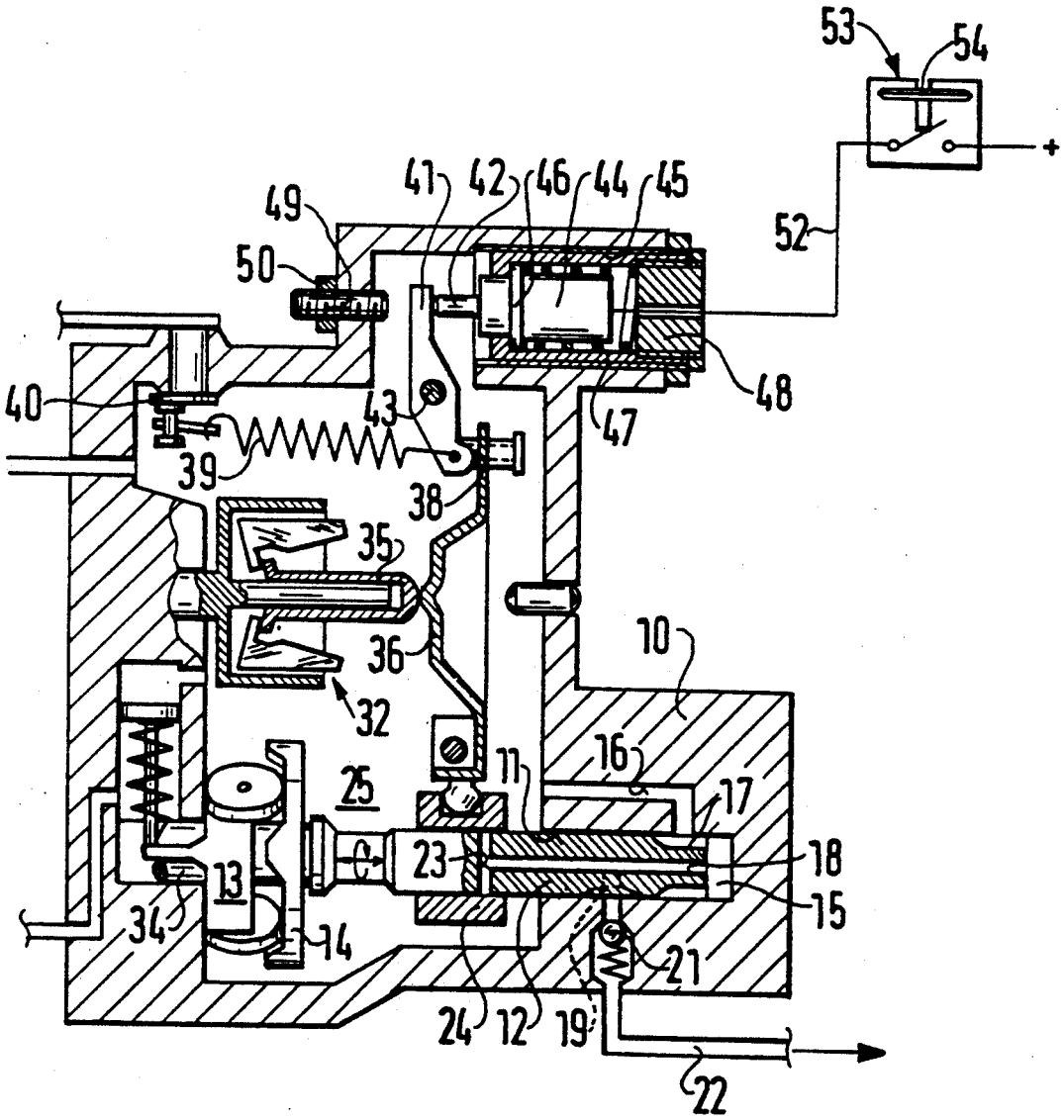
53
54
+
52
49
50
41
42
46
44
45
48
47
40
43
39
38
35
36
32
10
16
17
11
25
23
18
15
13
34
14
21
24
12
19
22

FUEL INJECTION PUMP FOR INTERNAL COMBUSTION ENGINES

BACKGROUND OF THE INVENTION

The invention relates a fuel injection pump for internal combustion engines. More particularly, the present invention relates to a fuel injection pump for internal combustion engines which has a fuel-quantity adjusting member and an associated adjusting device for altering the possible travel of the fuel-quantity adjusting member as a function of the atmospheric pressure.

Such a fuel injection pump has already been disclosed in German Offenlegungsschrift 3,430,141. This fuel injection pump has a stop lever which is adjustable via a transmission device by a pneumatic actuator as a function of the atmospheric pressure and against which a speed lever of the fuel injection pump. The speed lever serves as a fuel-quantity adjusting member, comes to rest at full load. The pneumatic actuator here comprises two diaphragm cells which are connected in series and change in length as a function of the atmospheric pressure. This change in length is transmitted to the stop lever via the transmission device, which has two discs coupled to one another in such a way that they can be dragged along. Assigned to the transmission device is a locking mechanism which locks the said device counter to the action of the force of the stop lever. The overall arrangement with the pneumatic actuator, the transmission device and the locking mechanism thus comprises a large number of individual parts and is expensive to manufacture and assemble.

SUMMARY OF THE INVENTION

It is therefore an object of the present invention to provide a fuel injection pump for internal combustion engines which avoids the disadvantages of the prior art.

In keeping with theses objects and with others which will become apparent hereinafter, one feature of the present invention resides, briefly stated in a fuel injection pump of the above mentioned general type in that the adjusting device has a switching element which is acted upon by atmospheric pressure and, as a function of the atmospheric pressure, closes and opens a circuit into which a working element acting on a stop lever is connected, and the working element changes its position or its length following the closure and opening of the circuit.

The fuel injection pump for an internal combustion engine designed in accordance with the present invention has the advantage that the stop lever is adjustable by simple means as a function of the atmospheric pressure.

In accordance with a further feature of the present invention the switching element is designed as an electrical switch, the circuit is designed as an electric circuit and the switching element closes the circuit when a certain value of the atmospheric pressure is undershot.

The working element in accordance with the present invention can be electrically heatable and can change in length as a function of temperature.

In accordance with still another feature of the present invention the working element is designed as an element based on an expanding material. With this feature the adjustment of the stop lever is limited to a predetermined value.

Further, the adjustment of the stop lever brought about by the working element can be limited by a counterstop.

The counterstop can be adjustable. On its side opposite to the stop lever, the working element can be supported via a spring. By virtue of the support of the working element, the working element can expand toward the spring when the stop lever is resting against the counterstop.

The novel features which are considered as characteristic for the invention are set forth in particular in the appended claims. The invention itself, however, both as to its construction and its method of operation, together with additional objects and advantages thereof, will be best understood from the following description of specific embodiment when read in connection with the accompanying drawings.

BRIEF DESCRIPTION OF THE DRAWINGS

The figure shows a fuel injection pump in the form of a longitudinal section.

DESCRIPTION OF A PREFERRED EMBODIMENT

A distributor-type fuel injection pump has a pump plunger 12 which operates in a cylinder bore 11 of a casing 10. A reciprocating and, simultaneously, a rotary motion are imparted to the plunger via a drive shaft 34 by a cam drive comprising a roller ring 13 and a front-face cam disc 14. During the suction stroke of the pump plunger 12, a pump working space 15 formed by the pump plunger 12 in the cylinder bore 11 is filled via a suction bore 16 and control grooves 17 in the pump plunger 12. During the delivery stroke of the pump plunger 12, with the suction bore 16 closed, the fuel is pumped via a longitudinal bore 18 and a distributor groove 19 connected to the latter, via a delivery valve 21 and a delivery line 22, to an injection nozzle (not shown) on a cylinder of the internal combustion engine operated using the fuel injection pump. The end of delivery is reached when a transverse bore 23 provided in the pump plunger 12 and connected to the longitudinal bore 18, is opened by an axially displaceable control slide 24 and the pump working space is relieved to an interior space 25. The fuel fed into the pump working space 15 via the suction bore 16 is removed from the injection-pump interior space 25. The space 23 serves as an inlet chamber, and the fuel released from the transverse bore 23 by the control slide 24 can also flow back into it. Fuel is fed to the interior space 25 from a reservoir by a feed pump (not shown).

A fuel-quantity adjusting device has a centrifugal speed governor 32. A rotary motion is imparted to the governor by the drive shaft 34 in a manner not shown in greater detail. Via a governor sleeve 35 and a speed lever 36, the governor actuates the control slide 24. Also acting on the speed lever 36 is a governing spring 39, which is articulated on a speed-adjusting lever 40 connected to the accelerator pedal. In this role, the speed lever 36 can be denoted as a fuel-quantity adjusting member. The axial position of the control slide 24 set by the speed lever 36 determines the end of delivery and hence the quantity injected by the fuel injection pump. In the illustrated full-load position of the speed lever 36, this lever rests against a stop lever 41.

The stop lever 41 is of two-armed design and is pivotably mounted on a stud 43. An adjusting device has a working element 44 which is inserted into a bush 45 screwed into the casing 10. It is designed as a transmitter based on an expanding material, rests with one side of a collar 46 in the bush 45, and a pin 42 projects through the bush 45 into the interior space 25 towards the stop lever 41. The working element 44 is pressed towards the stop lever 41 by a spring 47 which is supported against a cap part 48 inserted into the bush 45 and engages on the working element 44 on the other side of the collar 46. The bush 45 and the cap part 48 are fixed on the casing 10 and the bush 45, respectively, by means of a lock nut. By means of the bush 45, it is possible to set the position of the working element 44. Screwed into the casing 10 on that side of the stop lever 41 which is opposite to the pin 42 is a screw which serves as a counterstop 49 and is fixed on the casing 10 by means of a lock nut 50. The working element 44 is connected into an electric circuit 52, which is closed and opened by a switching element 53, acted upon by the atmospheric pressure, as a function of the atmospheric pressure. The switching element 53 is designed as an altitude switch with a diaphragm cell 54 which closes a contact in the switching element 53 upon expansion. When the atmospheric pressure changing with the altitude at which the motor-vehicle internal combustion engine supplied with the fuel injection pump is driven or changing due to some other cause undershoots a value determined by the design of the diaphragm cell 54, the diaphragm cell 54 closes the circuit 52 and the working element 44 is heated. As the temperature increases, the working element 44 expands and, via its pin 42, pivots the stop lever 41 in the direction of a decreasing fuel injection quantity. In order to limit the pivoting of the stop lever 41, the latter comes to rest against the counter stop 49 after a certain amount of pivoting. Any further expansion of the working element 44 which then occurs is possible towards the cap part 48, counter to the spring 47. When the switching element 53 opens the circuit 52 again due to an increase in the atmospheric pressure, the length of the working element 44 decreases due to cooling and the stop lever 41 is adjusted in the direction of an increasing fuel injection quantity.

The circuit 52 can also be designed as a pneumatic or hydraulic circuit. It is also possible for the switching element 53 to open and close a valve connected into the circuit 52. A working element 44 designed as a piston thereby is adjusted as a function of the pressure prevailing in the circuit 52. Finally, it is also possible to use a working element formed as an actuating magnet electrically controlled via the circuit.

It will be understood that each of the elements described above, or two or more together, may also find a useful application in other types of constructions differing from the types described above.

While the invention has been illustrated and described as embodied in a fuel injection pump for internal combustion engines, it is not intended o be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letter Patent is set forth in the appended claims.

1. A fuel injection pump for internal combustion engines, comprising a fuel-quantity adjusting member; an adjusting device associated with said adjusting member and a operative for altering a possible travel of said fuel-quantity adjusting member as a function of an atmospheric pressure, said adjusting device having a pivotally mounted two-armed stop lever against which said fuel-quantity adjusting member can be brought to rest, an electrical circuit, a working element which acts on said stop lever, and a switching element provided in said electrical circuit and in dependence upon the atmospheric pressure controlling said working element, said switch being actuated in response to exceeding a predetermined atmospheric pressure and opening and closing said electrical circuit, said working element being connected in said electrical circuit, and said two-armed stop lever being movable by said working element when said electrical circuit is closed due to a current flow from a first position to a second position which is defined by abutment of said stop lever against a counterstop.

2. A fuel injection pump as defined in claim 1, wherein said working element is composed of expanding material and changes its length as a function of temperature.

3. A fuel injection pump as defined in claim 1, wherein said counterstop is adjustable.

4. A fuel injection pump as defined in claim 3; and further comprising means for adjusting said counterstop.

5. A fuel injection pump as defined in claim 1; and further comprising a spring arranged so that said working element is supported by said spring at a side which is opposite to said stop lever.

* * * * *